US008783327B2

(12) United States Patent
Kraeutler

(10) Patent No.: US 8,783,327 B2
(45) Date of Patent: Jul. 22, 2014

(54) FLEXIBLE CURTAIN RAPID DOOR

(75) Inventor: Bernard Kraeutler, La Villette (FR)

(73) Assignee: Nergeco (FR)

( * ) Notice: Subject to any disclaimer, the term of this patent is extended or adjusted under 35 U.S.C. 154(b) by 523 days.

(21) Appl. No.: 11/718,830

(22) PCT Filed: Nov. 8, 2005

(86) PCT No.: PCT/FR2005/002785

§ 371 (c)(1),
(2), (4) Date: Jun. 29, 2007

(87) PCT Pub. No.: WO2006/051213

PCT Pub. Date: May 18, 2006

(65) Prior Publication Data

US 2007/0261305 A1 Nov. 15, 2007

(30) Foreign Application Priority Data

Nov. 8, 2004 (FR) ..... 04 11890

(51) Int. Cl.
*E05F 15/20* (2006.01)
*A47G 5/02* (2006.01)
*A47H 1/00* (2006.01)

(52) U.S. Cl.
USPC ..... 160/3; 160/1; 160/8; 160/264; 160/310

(58) Field of Classification Search
USPC ..... 160/310, 349.1, 84.02, 84.06, 188, 133, 160/1; 200/61.43; 250/216, 221, 222.1; 49/26, 27, 28, 31
See application file for complete search history.

(56) References Cited

U.S. PATENT DOCUMENTS

| | | | | | |
|---|---|---|---|---|---|
| 4,953,608 | A | * | 9/1990 | Larsson | 160/1 |
| 5,222,541 | A | * | 6/1993 | Hornberger | 160/265 |
| RE34,665 | E | * | 7/1994 | Strand | 250/221 |
| 5,964,058 | A | * | 10/1999 | Richardson | 49/27 |
| 7,151,450 | B2 | * | 12/2006 | Beggs et al. | 340/545.1 |

FOREIGN PATENT DOCUMENTS

| | | |
|---|---|---|
| DE | 296 23 251 | 2/1998 |
| FR | 2769944 | * 10/1997 |
| JP | 2003 120154 | 4/2003 |
| JP | 2004 156394 | 6/2004 |
| JP | 2004 293173 | 10/2004 |

OTHER PUBLICATIONS

International Search Report; PCT/FR2005/002785; Mar. 2, 2006.

* cited by examiner

*Primary Examiner* — Katherine Mitchell
*Assistant Examiner* — Jeremy Ramsey
(74) *Attorney, Agent, or Firm* — Cantor Colburn LLP

(57) ABSTRACT

The inventive flexible curtain rapid door comprises a structure consisting of two posts and a transverse element for guiding a flexible curtain and electromechanical means supported by said structure for displacing the curtain between open and closed positions, wherein the flexible curtain (2) comprises a weight and sealing element (13). According to the invention, the door comprises obstacle detecting means which are carried at least partially by an reinforcing element, are adjacent to the weight and sealing element (13) and are disposed upstream thereof on the curtain closing path between the reinforcing element and the weight and sealing element (13) and said obstacle detecting means are integrated inside the lower part of the curtain (2).

17 Claims, 4 Drawing Sheets

FLEXIBLE CURTAIN RAPID DOOR

TECHNICAL FIELD OF THE INVENTION

The present invention relates to a flexible curtain rapid door.

BRIEF DISCUSSION OF RELATED ART

Flexible curtain doors, whether they be vertical folding or roller or horizontal retraction doors, have the particular feature of being operated at high linear speeds. These high opening and closing speeds are made possible by the low inertia of the flexible curtain usually made of PVC or a similar flexible material.

It is therefore essential to protect the operation of these doors and prevent, during an accidental collision between a person or an object and the curtain, crushing or damaging the person, the object or the curtain.

There are several systems providing a certain protection of the operation of flexible screen rapid doors by the detection of objects or of people that are accidentally under the curtain or immediately next to the latter when it closes.

A first detection system provides for fitting a perimeter of presence detectors around the door. Usually several presence detectors are necessary to protect a sufficient perimeter to detect the presence of a person or an object during a closing phase of the door, which then has a risk of collision and crushing or of damaging the curtain. These systems are however costly and may be sensitive to false alarms.

There are also detection systems operating on the principle of detection of a contact. The detection of a contact during the closing phase of the curtain generates a signal, usually electric, that causes the closure phase of the curtain to stop.

In the case of a curtain fitted with reinforcing bars particularly in its bottom portion, a known detection system consists in adding a detection means beneath the bottom rigid reinforcing bar. This detection means which, for example, may be an air bolster, is squashed against the rigid bar during a collision with a person or an object.

The squashing of the detection means against the rigid bar is converted into an electric signal that causes the curtain to stop and immediately reopen.

In the case of an air bolster that collides with a person, the latter is squashed against the bottom rigid bar of the curtain. This squashing causes an excess pressure in the bolster that is detected by a pressure switch.

This type of protection system has many disadvantages in use.

In the first place, they can detect only objects that are accidentally situated in the opening plane of the curtain, that is to say in the vertical of the bottom bar.

A second major disadvantage is that the detection means are in the bottom portion of the curtain beneath the bottom rigid bar. Consequently, these detection means are exposed to much damage. The first damage is repeated contact with the ground in the case of a vertical folding or roller door, or with an upright in the case of a horizontal retraction door. This leads to extremely rapid wear of these detection means. In addition, when the door is open, the detection means may be caught or damaged by machines passing through the door. In the event of a malfunction of the detection system, the curtain can only descend, crushing the person or the object that is in its trajectory and itself being damaged as might happen.

An additional disadvantage of this type of detection means is that, in the case of a collision on a horizontal component, the collision occurs between a person, for example the head of this person, and the bottom bar that is heavy and rigid, which may cause possibly serious injuries. Similarly, a collision with a machine may also have major consequences for the object or the machine passing through the door, and for the contact detection means that are directly exposed since they are suspended on the bottom bar.

In addition, these detection means have a response time that may be relatively long, which renders them ineffective when they are fitted to flexible curtain rapid doors. Specifically, the detection means are placed in a flexible band suspended beneath the bottom bar; the thinness of this band that covers the detection means causes this band to be squashed before the drive motor of the curtain stops. Despite the action of the detection means, a contact inevitably occurs with the bottom rigid bar, which may, possibly have serious consequences.

BRIEF SUMMARY OF THE INVENTION

The invention proposes a flexible curtain rapid door having means for detecting a collision between a flexible curtain and a person or an object that are reliable and largely insensitive to wear.

The invention further proposes a flexible curtain rapid door having detection means that may detect a collision occurring in a horizontal direction between a flexible curtain and a person or an object.

In a manner known per se, a rapid door comprises:

- a structure comprising uprights and a transverse element making it possible to guide a curtain,
- electromechanical means supported by the structure making it possible to maneuver the curtain between an open position and a closed position,
- the curtain having, at its free end, a ballast and sealing element.

According to the invention, the door has obstacle detection means supported at least partly by the reinforcing element, said obstacle detection means being adjacent to the ballast and sealing element and situated upstream of the latter, on the closing trajectory of the curtain, between the reinforcing element and the ballast and sealing element and in that said obstacle detection means are incorporated inside the bottom portion of the curtain.

Thus, the idea at the basis of the invention is to incorporate into the curtain itself obstacle detection means for protecting the operation of the door.

This is done by placing them upstream of the ballast and sealing element. "Upstream" means above the ballast and sealing element in the case of a vertical-opening door and behind the ballast and sealing element in the case of a lateral-opening door, the term "upstream" having to be understood relative to the closing trajectory of the curtain. The detection means are protected mechanically by the ballast and sealing element. They are triggered, when appropriate, by the deformation of the ballast and sealing element when the curtain comes into contact with an obstacle that is beneath the curtain when it closes, in the case of a vertical-action door, or when the curtain comes into contact with an obstacle that is on the closing trajectory, in the case of a horizontal-action door.

It is also noted that, in the case where the ballast and sealing element is flexible, it deforms and triggers the detection means during a collision irrespective of the direction in which the collision occurs. In other words, a collision on a vertical or horizontal component or in a component of any orientation will be detected.

According to a preferred embodiment of the invention, the obstacle detection means have a normal operating position of the curtain in which the detection means are parallel to the ballast and sealing element and an abnormal operating position of the curtain in which the obstacle detection means are diverted or interrupted from their axis parallel to the ballast and sealing element by a deformation or a movement of the ballast and sealing element when it encounters an obstacle.

According to a preferred embodiment of the invention, the curtain has at least one reinforcing element parallel to the ballast and sealing element, the detection means being situated between the reinforcing element and the ballast and sealing element. This disposition clearly demonstrates the integration of the detection means in the curtain.

To adjust the sensitivity of the detection means, particularly according to the speed of the curtain, provision is made for the obstacle detection means to be situated at a programmable distance from the ballast and sealing element.

In one embodiment of the obstacle detection means, the latter consist of a cell for emitting a beam supported at one end of the reinforcing element and a cell for receiving the beam supported at the other end of the reinforcing bar, the beam between the emitting cell and the receiving cell being parallel to the ballast and sealing element, and being able to be cut by a deformation of the ballast and sealing element when it encounters an obstacle.

In one embodiment, the ballast and sealing element comprises, on its face opposite to the beam, at each of its ends, at least one flag that cuts the beam, when the ballast and sealing element is deformed when it encounters an obstacle.

According to one possibility, each end of the flexible reinforcing bar receives a stay to which is attached the receiving cell and the emitting cell.

To make it possible to adjust the distance between the ballast and sealing element and the beam, each stay has several locations for the reception of the emitting and receiving cells.

Depending on the case, the beam defined between the emitting cell and the receiving cell is a beam from the group consisting of an optical beam, an acoustic beam, a laser beam, and a narrow sweep angle radar beam.

In another embodiment of the obstacle detection means, the latter consist of a cable, stretched parallel to the ballast and sealing element, capable, of being deformed by a deformation or a movement of the ballast and sealing element when it encounters an obstacle.

To hold the cable, the reinforcing bar has a stay at each of its ends, the cable being stretched between the two stays.

It is noted according to one embodiment that the cable is held at one stay by a spring and at the other stay by a pull rod contact that can be triggered in the event of deformation of the cable.

In another embodiment, the detection means are connected via a wire connection to the control electronic or electromechanical elements of the electromechanical means for operating the curtain.

The invention relates to several types of door, particularly:

the door is a roller door having a single-apron curtain, the door is a folding door having a single-apron curtain, the door is a folding door having a double-apron curtain.

In a preferred manner, the ballast and sealing element consists of a spring covered by a foam sleeve free at its ends or having at each of its ends an end-piece able to engage in a slider of an upright. This embodiment of the ballast and sealing element is of value to the extent that this element with this structure may deform just as well in a direction indistinguishable from the plane of the curtain as in a direction perpendicular to the plane of the curtain and any other direction lying between the plane of the curtain and a perpendicular plane. The ballast and sealing element could also consist of a bolster filled with sand, fine gravel or any other filling material ensuring that it can deform.

In one embodiment, the end portion of the curtain has a U-shaped cover being attached to the outer faces of the curtain that incorporates a sheath in which the ballast and sealing element is engaged.

To prevent superfluous triggering, that is to say triggering that is not a consequence of a collision of the detection means with an obstacle, the bottom portion of the door is fitted with retractors situated around the detection means.

In terms of action following an incident, the triggering of the detection means generates at least one action from the group consisting of:

a stopping of the curtain, an opening of the curtain, the transmission of a signal, the transmission of an audible signal, the transmission of a light signal, the transmission of a microwave signal, the triggering of an action, the triggering of an item of information, an incrementation of an incident history.

This group is nonlimiting and the action engaged could even be the transmission of an electronic or telephonic message, or the activation of a cinecamera or a still camera.

According to one possibility, the reinforcing element situated upstream of the ballast and sealing element is guided at least one of its ends in normal operation of the door.

Advantageously, the reinforcing element consists of a flexible bar having an overall flexibility allowing it not to sustain permanent deformation in the event of a collision.

In the case of a flexible curtain with two aprons, the reinforcing element consists of two parallel bars connected by struts.

Advantageously, the obstacle detection means are incorporated inside the bottom portion of the curtain.

BRIEF DESCRIPTION OF THE DRAWINGS

For a good understanding thereof, the invention is described with reference to the appended drawing representing, as a nonlimiting example, several types of curtain incorporating obstacle detection means according to the latter.

DETAILED DESCRIPTION OF THE INVENTION

As the figures show, the obstacle detection means may be included in flexible curtain rapid doors. Usually, they are doors having a structure comprising uprights and a transverse element making it possible to guide the curtain, and electromechanical means (electric motor, reduction gear, control electronic or electromechanical elements) supported by the structure making it possible to maneuver the curtain between an open position and a closed position. The structure of these doors is widely known and will not be described further. It will however be specified that certain rapid doors are fitted with a curtain that has, at its free end, a ballast and sealing element. This flexible ballast and sealing element has the function of tensioning the curtain and, when the door is closed, of ensuring a good seal of the door by pressing against the ground without being damaged by the repeated contacts with the ground.

For simplification purposes, it is specified that the elements that are in the various embodiments are indicated by the same reference numbers.

Figure 1:
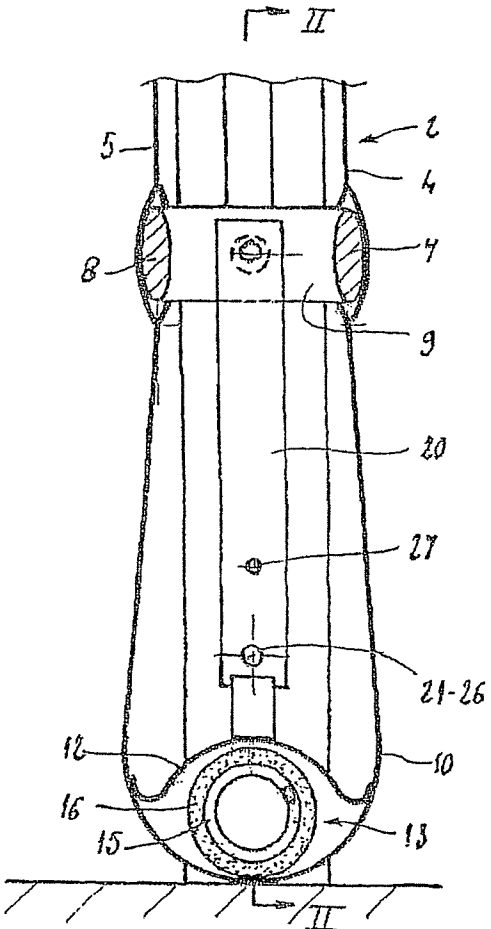
FIG. 1 is a side view of a double curtain of a folding door.

For the description of the invention, reference will first be made to FIG. 1.

The latter represents the bottom portion of a double-curtain 2 folding door. Naturally, the top portion of this door comprises an electric motor system that makes it possible to raise and lower this curtain.

On the bottom portion of this door, it can be seen that the curtain 2 has two aprons 4 and 5 that each support a horizontal stiffener bar 7 and 8. These two stiffener bars 7 and 8 are connected together by a connecting strut 9 that can be clearly seen in FIG. 1.

At the end of the curtain, a U-shaped cover 10 is provided that is attached to each of the aprons 4, 5. This cover 10 is usually made of a thick material that withstands repeated contacts with the ground. The U-shaped cover 10 receives a sheath 12 into which a ballast and sealing element 13 is slid. This ballast and sealing element 13 comprises two bob ballast weights 14 at each end of the bar. A spring 15 is placed between these bob ballast weights 14, the assembly being engaged in a foam sleeve 16. Note also that the ballast and sealing element 13 has guide end-pieces 17 that can engage in slides with which the uprights 18 of the door are fitted.

Figure 2:
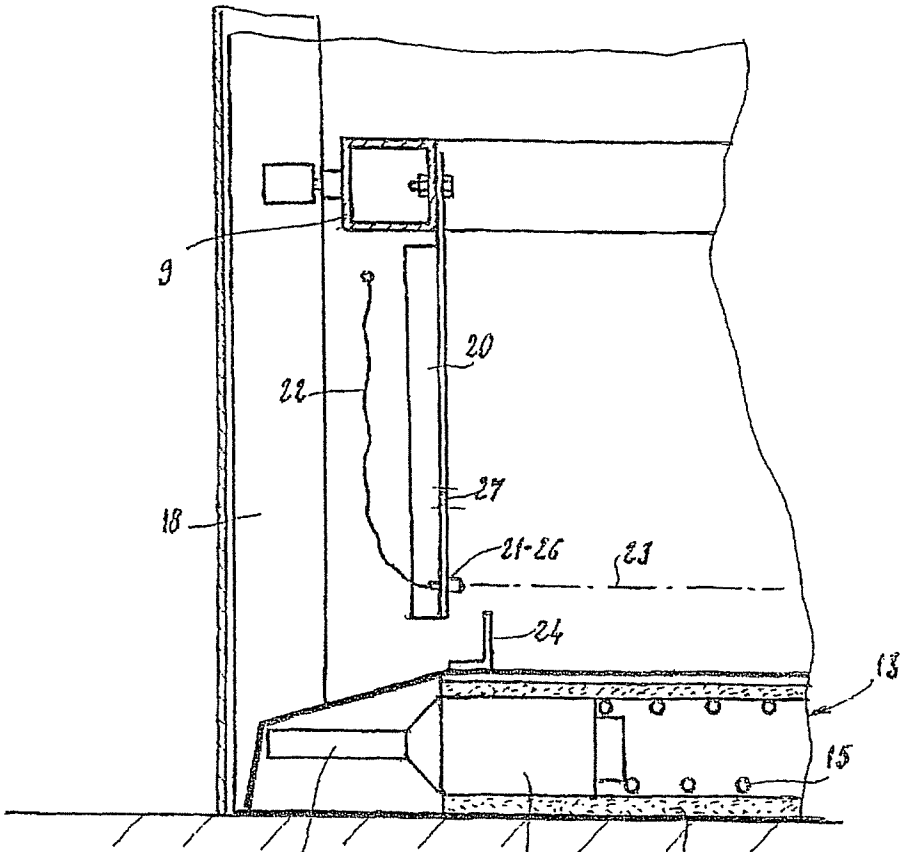
FIG. 2 is a view in section along II-II of FIG. 1.

When reference is made to FIG. 2, it can be seen that the curtain is fitted with a stay 20 that is bolted into the strut connecting the two stiffeners.

It should be noted that the curtain 2 has a symmetrical structure and there is the same construction at the other end of the stiffener bars 7, 8.

The absolutely characteristic point of this curtain is that the stay supports a cell 21 that emits an optical beam 23 that is parallel to and upstream of the ballast and sealing element 13. Facing this emitting cell 21, the second supporting stay is fitted, for its part, with a receiving cell. In another possibility, one of the stays 20 is fitted with an emitting/receiving cell while the other stay simply receives a passive cell for sending back the beam. The receiving cell is connected via a wire connection 22 to the control electronic or electromechanical elements of the curtain 2.

Note furthermore that the ballast and sealing element 13 receives, on its face that is opposite the supporting stays 20, at each of its ends, a detection flag 24 that consists of an L-shaped section.

The operation of the detection device is therefore as follows. When the ballast and sealing element 13 encounters an obstacle during its descent, it deforms since it consists, for its essential part, of a spring and a foam sleeve. The deformation of the ballast and sealing element 13 changes the trim of one or both flags 24 which then cut the beam that is usually parallel to the ballast and sealing element 13. The beam 23 being cut, a signal is sent to the control electronic or electromechanical elements of the door that then give the instruction, on the one hand, to stop the descent of the curtain, and on the other hand, to raise the latter.

It can be seen therefore that, during a collision for example with a person, this collision occurs with an element that is essentially flexible and that, during its deformation, gives an instruction for the curtain to be raised.

It is noted, in a completely interesting manner, that the stay 24 has two reception zones 26, 27 for the cell 21 emitting the beam 23, so that the space existing between the ballast and sealing element and the axis of the beam can be made to vary. Therefore, in the case of a slow door, it will be possible to have a relatively large space, while, in the case of a door descending at great speed, it will be necessary to have a sensitive device and, in this case, the space between the ballast and sealing element and the axis of the beam will be as small as possible in order to have the quickest possible detection.

Figure 4:
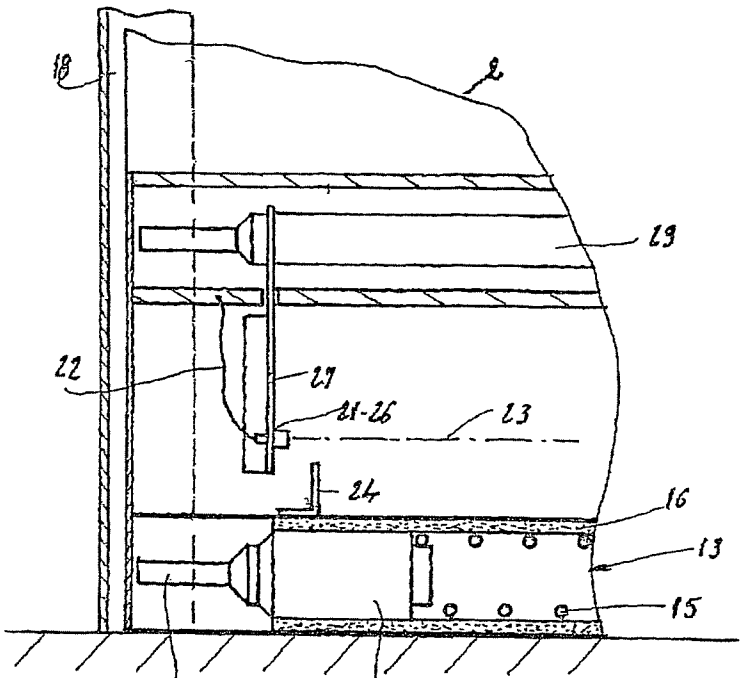
FIG. 4 is a view in section along IV-IV of FIG. 3.
Figure 3:
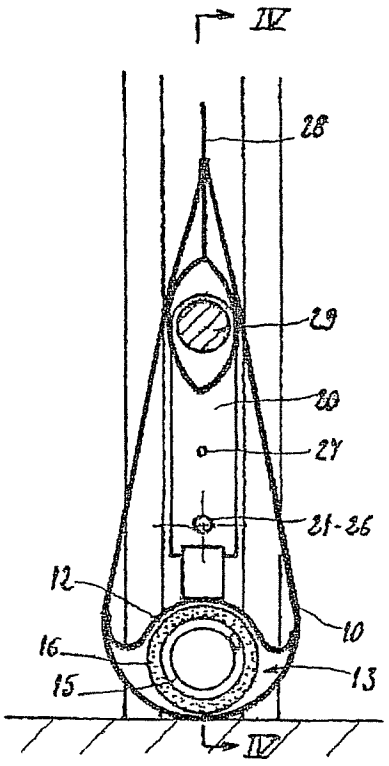
FIG. 3 is a side view of the bottom portion of the curtain of a vertical roller door.

FIGS. 3 and 4 show the device fitted to a vertical roller door. The detection means are fully comparable to those that have just been described.

As shown in FIG. 3, a vertical roller door has a curtain having a single apron 28 which, at its bottom end, has a U-shaped cover 10 that is attached to each of the faces of the apron 28. A sheath 12 is formed in the U-shaped cover in which a ballast and sealing element 13 is engaged having the same structure as that described above, that is to say an element having a certain weight to ballast the curtain, but having a certain flexibility so as to deform during an impact.

FIG. 3 shows that the curtain incorporates a transverse stiffener bar 29, this transverse stiffener bar 29 being a conventional element of the curtains of a vertical roller door. This stiffener bar supports, at each of its ends, a stay 20; one of these stays receives an emitting cell 21, while the other receives a receiving cell. These two cells 21 therefore define a beam axis 23 parallel to the axis of the bottom ballast and sealing element.

In normal operation, the axis of the beam 23 is strictly parallel to the axis of the ballast and sealing element 13.

As can be seen in the figure, note that the ballast and sealing element supports, at each of its ends, a flag 24, that is to say an L-shaped section. When the ballast and sealing element 13 encounters an obstacle, it deforms and the flag 24 cuts the optical beam. The cutting of this optical beam 23 is indicated to the control electronic or electromechanical elements of the door that instruct the curtain to raise.

It should be noted that the control electronic or electromechanical elements may trigger any other visual or audible signal making it possible to give the alert of an accident. In addition, the accidents can be counted in order to ascertain the history of the door.

Figure 5:
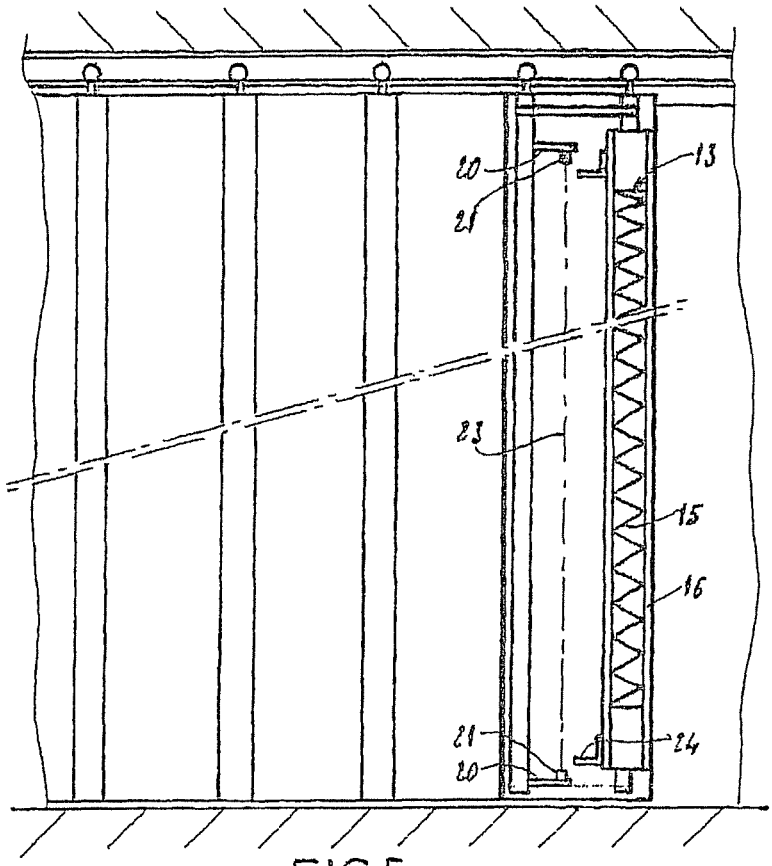
FIG. 5 is a view of a lateral retracting door.

FIG. 5 shows a door operating according to a different principle in that the curtain 2 retracts laterally between its open position and its closed position.

The structure of the detection means is fully comparable with that used for vertical folding or roller doors. Specifically, this door has a ballast and sealing element 13 which, naturally in the present case, is oriented in the vertical direction; this ballast and sealing element has a structure that is fully comparable with that of the ballast and sealing element of the doors previously described, that is to say a spring sleeved in foam.

A stiffener bar 30 parallel to the end bar supports two stays 24, one being fitted with an emitting cell 21, the other being fitted with a receiving cell, so that a beam 23 parallel to the end bar is defined between these two cells.

When the curtain 2 collides with an obstacle, whether it be a person or an object, the ballast and sealing element 13 deforms and one or the flags 24 cuts the beam 23 defined between the two cells; this then triggers in the control electronic or electromechanical elements an appropriate and predetermined action that is usually the stopping of the motor and the opening of the door accompanied, where necessary, by an audible or visual signal. Although the drawing represents a laterally retracting door having a single curtain, it is of course quite conceivable to fit a contact detection device to a laterally retracting door having two flexible curtains.

Figure 6:
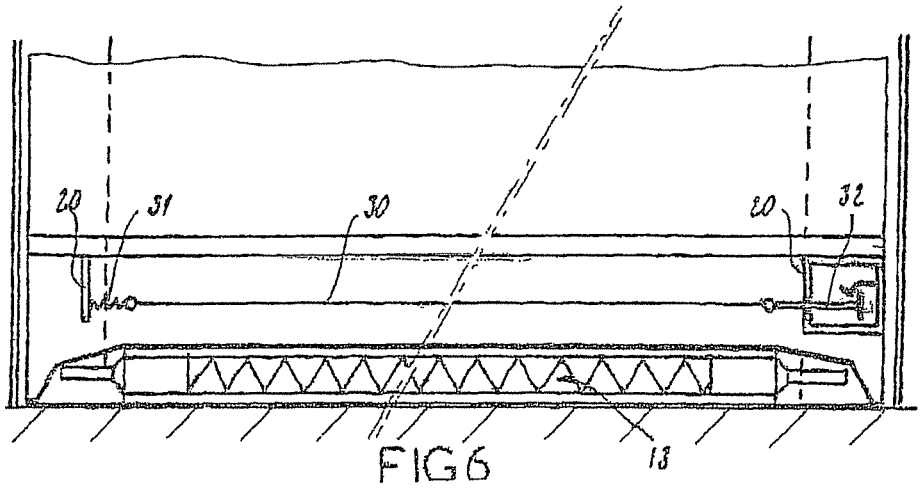
FIG. 6 shows another embodiment of obstacle detection means on a vertical roller door.

It should be noted that the detection device according to the invention may take another embodiment represented in FIG. 6 since it is possible to provide, parallel to the axis of the ballast and sealing element, a cable 30 which, at one of its ends, is held by a spring 31 to a supporting stay 20 and, at its other end, is held by the supporting stay by means of a pull rod contact 32.

During a deformation of the ballast and sealing element 13 following a collision with an obstacle, the ballast and sealing element comes into contact with the cable and changes its tension. This change of tension is converted at the pull rod contact 32 into an electric signal that is transmitted to the control electronic or electromechanical elements which, here again, take the appropriate predetermined action.

Figure 7:
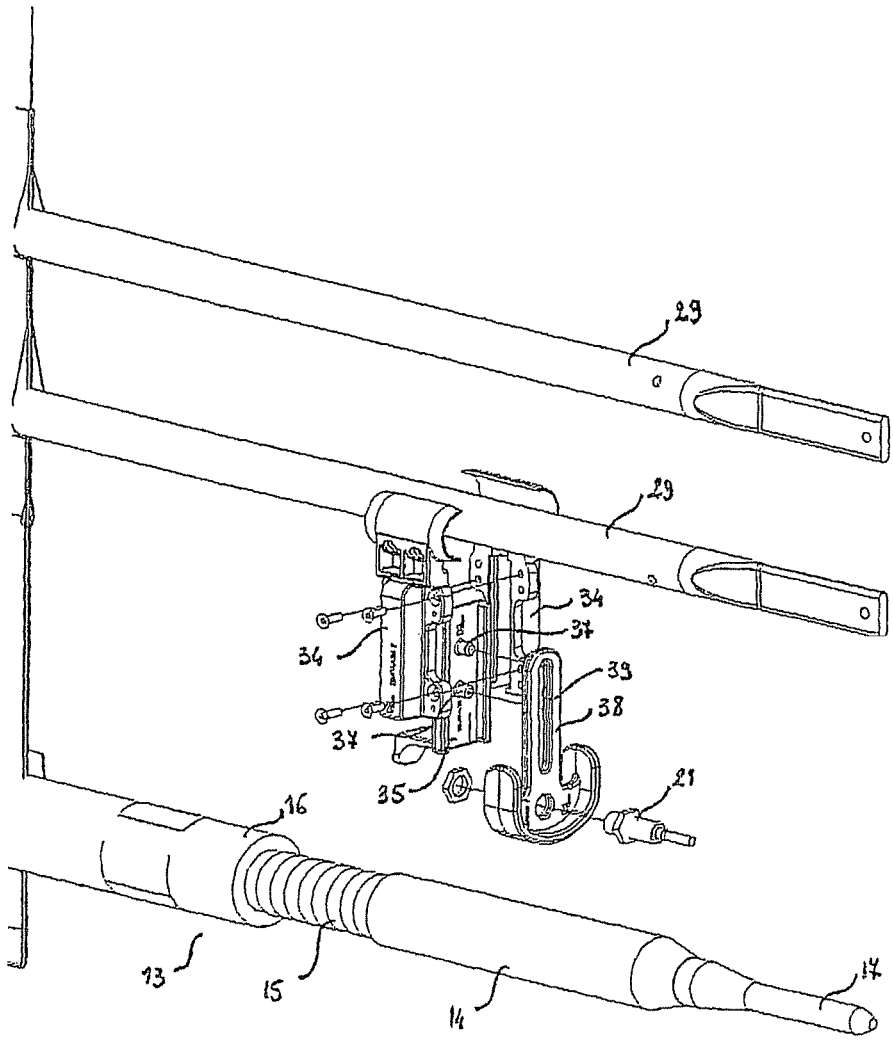
FIG. 7 is an exploded view in perspective of another embodiment of obstacle detection means on a horizontal roller door.

FIG. 7 illustrates another embodiment of the obstacle detection means in which a cell 21 is connected to a transverse reinforcing bar 29 by a stay 24. In the embodiment illustrated, the stay 24 comprises two symmetrical supports 34 that each have a concave portion that can grip the transverse reinforcing bar 29. The two supports 34 furthermore grip a plate 35. The plate 35 has, as can be seen in FIG. 7, two threaded rods 37; these threaded rods have the function of receiving a fitting 38. Note that the fitting 38 to which the cell 21 is attached has an oblong slot 39 that can be engaged on the threaded rod 37. This arrangement makes it possible to adjust the position of the cell 21 relative to the element 13. Naturally, another stay symmetrical to that which has just been described may be placed at the other end of the transverse reinforcing bar 29.

The invention, in its various embodiments, therefore has the many advantages indicated. Specifically, the detection device is fully protected since it is, relative to the ballast and sealing element or the end bar, on its face opposite to its face that is in contact with the ground or an upright. This very favorably contributes to the general reliability of the device.

Furthermore, this device may be very easily programmed since different positions for the emitting and receiving cells are provided in the supporting stays 20.

In addition, the device operates in the case of a collision in a direction other than vertical, for example horizontal or on any component lying between these two directions since, in all the situations that have been described, when the bottom bar is moved along a horizontal component, the beam or the cable, depending on the case, is cut or slackened, which has the effect of triggering the opening of the curtain.

Naturally, the invention is not limited to the embodiment described above as a nonlimiting example, but, on the contrary, it embraces all the variant embodiments thereof.

The invention claimed is:

1. A flexible curtain door comprising:

a structure comprising uprights and a transverse element making it possible to guide a flexible curtain, electromechanical means supported by the structure making it possible to maneuver the curtain between an open position and a closed position, the flexible curtain comprising:

a flexible material of a substantial entirety of the curtain;

at its free end, a multi-directional ballast and sealing element, at least one reinforcing element traversing a substantial width of the curtain and being disposed substantially within the curtain, the reinforcing element being substantially parallel to the ballast and sealing element, and the reinforcing element including a first stay and a second stay that are each disposed entirely within the curtain, wherein the door has obstacle detection means supported at least partly by the reinforcing element, the obstacle detection means being adjacent to the ballast and sealing element and situated upstream of the sealing element, on a closing trajectory of the curtain, between the reinforcing element and the ballast and sealing element, wherein the obstacle detection means comprises an emitting cell for emitting a beam supported by the first stay, and a receiving cell for receiving the beam supported at the other end of the reinforcing element by the second stay, such that the emitting cell, the receiving cell, and the first stay and the second stay that support the emitting cell and the receiving cell are disposed entirely within the curtain, the beam between the emitting cell and the receiving cell being parallel to the reinforcing element and the ballast and sealing element, being transmitted from the emitting cell to the receiving cell via a space disposed outside of any rigid enclosure, and being able to be cut by a deformation of the ballast and sealing element when it encounters an obstacle.

2. The flexible curtain door as claimed in claim 1, wherein the obstacle detection means have a normal operating position of the curtain in which the detection means are parallel to the ballast and sealing element and an abnormal operating position of the curtain in which the obstacle detection means are diverted or interrupted from their axis parallel to the ballast and sealing element by a deformation or a movement of the ballast and sealing element when it encounters an obstacle.

3. The door as claimed in claim 1, wherein the emitting cell and the receiving cell are situated between the reinforcing element and the ballast and sealing element.

4. The door as claimed in claim 1, wherein the obstacle detection means are situated at a programmable distance from the ballast and sealing element via variable vertical positioning of the emitting cell and the receiving cell along the first stay and the second stay respectively.

5. The door as claimed in claim 1, wherein the ballast and sealing element comprises, on its face opposite to the beam, at each of its ends, at least one flag that cuts the beam, when the ballast and sealing element is deformed or moved when it encounters an obstacle.

6. The door as claimed in claim 1, wherein the beam defined between the emitting cell and the receiving cell is a beam from the group consisting of an optical beam, an acoustic beam, a laser beam, and a narrow sweep angle radar beam.

7. The door as claimed in claim 1, wherein the detection means are connected via a wire connection to control electronic or electromechanical elements of the electromechanical means for operating the curtain.

8. The door as claimed in claim 1, wherein the door is a roller door having a single-apron curtain.

9. The door as claimed in claim 1, wherein the door is a folding door having a single-apron curtain.

10. The door as claimed in claim 1, wherein the door is a folding door having a curtain with double aprons.

11. The door as claimed in claim 8, characterized in that the ballast and sealing element comprises a spring covered by a foam sleeve free at its ends or having at each of its ends an end-piece able to engage in a slider of an upright.

12. The door as claimed in claim 8, wherein the end portion has a U-shaped cover being attached to outer faces of the curtain that incorporates a sheath in which the ballast and sealing element is engaged.

13. The door as claimed in claims 1, wherein a triggering of the detection means generates at least one action from the group consisting of:

stopping of the curtain,
opening of the curtain,
transmission of a signal,
transmission of an audible signal,
transmission of a light signal,
transmission of a microwave signal,
triggering of an action,
triggering of an item of information, and
incrementation of an incident history.

14. The door as claimed in claim 4, wherein the reinforcing element situated upstream of the ballast and sealing element is guided at at least one of its ends in normal operation of the door.

15. The door as claimed in claim 4, wherein the reinforcing element comprises a flexible bar having an overall flexibility allowing it not to sustain any permanent deformation in the event of a collision.

16. The door as claimed in claim 10, characterized in that the reinforcing element comprises two parallel bars connected by struts.

17. The door as claimed in claim 1, wherein the obstacle detection means are incorporated inside a bottom portion of the curtain.

* * * * *